US005533831A

United States Patent [19]

Allen

[11] Patent Number: 5,533,831

[45] Date of Patent: Jul. 9, 1996

[54] OBSTACLE BYPASS SYSTEM FOR CONCRETE FINISHING TOOLS

[75] Inventor: J. Dewayne Allen, Paragould, Ark.

[73] Assignee: Allen Engineering Corporation, Paragould, Ark.

[21] Appl. No.: 231,404

[22] Filed: Apr. 22, 1994

Related U.S. Application Data

[63] Continuation-in-part of Ser. No. 903,936, Jun. 26, 1992, Pat. No. 5,288,166.

[51] Int. Cl.[6] ..... E01C 19/38

[52] U.S. Cl. ..... 404/114; 404/118

[58] Field of Search ..... 404/96, 104, 114, 404/118

[56] References Cited

U.S. PATENT DOCUMENTS

| | | | |
|---|---|---|---|
| 2,314,985 | 3/1943 | Jackson | 94/45 |
| 2,542,979 | 2/1951 | Barnes | 94/48 |
| 2,651,980 | 9/1953 | Wells | 94/48 |
| 2,693,136 | 11/1954 | Barnes | 94/48 |
| 3,095,789 | 7/1963 | Melvin | 94/45 |
| 3,572,227 | 3/1971 | Poulsen | 404/118 X |
| 3,907,451 | 9/1975 | Fisher et al. | 404/101 |
| 4,030,873 | 6/1977 | Morrison | 425/456 |
| 4,105,355 | 8/1978 | King | 404/114 |
| 4,316,715 | 2/1982 | Allen | 425/456 |
| 4,340,351 | 7/1982 | Owens | 425/456 |
| 4,349,328 | 9/1982 | Allen | 425/456 |
| 4,363,618 | 12/1982 | Allen | 425/458 |
| 4,375,351 | 3/1983 | Allen | 425/456 |
| 4,386,901 | 6/1983 | Morrison | 425/456 |
| 4,427,358 | 1/1984 | Stilwell | 425/432 |
| 4,431,336 | 2/1984 | Nightengale | 404/97 |
| 4,650,366 | 3/1987 | Morrison | 404/114 |
| 4,702,642 | 10/1987 | Musil | 404/118 |
| 4,798,494 | 1/1989 | Allen | 404/114 |
| 5,344,254 | 9/1994 | Sartain | 404/104 |

FOREIGN PATENT DOCUMENTS

| | | | |
|---|---|---|---|
| 990565 | 6/1976 | Canada | 404/118 |
| 517579 | 12/1992 | European Pat. Off. | 404/118 |
| 185284 | 9/1966 | U.S.S.R. | 404/104 |

OTHER PUBLICATIONS

Allen Engineering Corp. (Brochure), Screed Accessories (No Date).

*Primary Examiner*—John Husar

*Attorney, Agent, or Firm*—Stephen D. Carver; Trent C. Keisling

[57] ABSTRACT

A concrete finishing tool that quickly changes in length to selectively bypass columns, curbs and other obstacles during concrete finishing includes a unique foldable bypass system at an extremity that can be folded between extended and retracted positions. When actively deployed the bypass is aligned for finishing concrete. In the retracted position it assumes a clearance orientation out of contact with the concrete. The bypass comprises a finishing wing for contacting concrete, a linkage system and a vibrator. The wing may comprise a forward strike-off and a trailing float. The linkage system comprises a pair of abutting links interconnected at an axially offset intermediate pivot point. One of the links is pivotally attached to the tool and the other link is pivotally attached to the wing. When the linkage system folds the links are moved between length additive and length subtractive orientations. Preferably the links pass overcenter when they are manipulated to yieldably lock the wing in either the deployed or retracted positions.

15 Claims, 6 Drawing Sheets

OBSTACLE BYPASS SYSTEM FOR CONCRETE FINISHING TOOLS

CROSS-REFERENCE TO RELATED APPLICATION

This is a Continuation-in-Part of prior patent application Ser. No. 07/903,936, filed Jun. 26, 1992, now U.S. Pat. No. 5,288,166, GAU 3206, Examiner J. M. Husar, entitled: Laser Operated Automatic Grade Control System for Concrete Finishing.

BACKGROUND OF THE INVENTION

I. Field of the Invention

The present invention relates generally to screeds and strike-offs for placing, screeding, finishing and shaping plastic concrete. More particularly, the present invention relates to a dynamic system for elongated finishing tools and concrete tools that can be selectively extended or retracted to avoid obstacles.

II. The Prior Art

As recognized by those skilled in the concrete finishing arts, after concrete is initially placed during construction, the upper surface must be appropriately finished. The purpose of finishing is to give the concrete a smooth, homogeneous and correctly textured surface and appearance. Various finishing devices, including screeds, have long been in use throughout the industry for treating plastic concrete. Known prior art systems include "bull" floats, finishing boards, strike-offs, pan floats, plows, blades and the like.

Strike-offs contact rough, freshly placed plastic concrete with a rigid leading edge to initially form and grade fresh concrete. Bull floats, comprising a flat, wooden board attached to a handle, can be manipulated by a single worker. Screeds are elongated tools employing a leading strike-off or blade that are moved over the concrete. They may employ flotation means, or they may ride forms. Modern screeds allow several finishing steps to be accomplished in a single pass.

Those skilled in the art will recognize that the selected finishing equipment must be appropriately matched to the job. For example, the type of equipment must be chosen based on the condition of the concrete. If high slump concrete is to be screeded, a floating pan would be ideal. For finishing drier concrete, a heavier twin-bladed screed might be more desirable. In all cases it is desirable to automatically insure level finishing.

The selection of an appropriate blade design for a particular screed is based upon a variety of factors related to the concrete involved. The characteristics of a particular batch of concrete depend upon the type and percentage of aggregate, and the quality and quantity of sand, cement, ad-mix, water and chemical additives forming the mix. Other variables, such as temperature, slab thickness, slump and placement method also affect blade selection and the application procedure.

It is an established fact in the art that vibration facilitates concrete finishing and consolidation. Many vibrating systems are presently in use in the industry. Vibration during screeding helps to settle or consolidate the concrete, thus eliminating air voids. Additionally, it helps to densify and compact the concrete during finishing. Vibrational screeding also draws out excess water, which increases the cured strength of the placed concrete. A fine layer of component cement and sand aggregate is raised to the surface with the excess water. This slurry aids in the subsequent fine finishing of the concrete and promotes the attainment of a uniform product.

I hold several patents in the art of concrete placement and finishing. U.S. Pat. No. 4,349,328, teaches a self-propelled "triangular truss" screed that rides upon forms. U.S. Pat. No. 4,798,494 discloses a floating vibratory screed that finishes concrete with or without forms. Finally, U.S. Pat. Nos. 4,316,715; 4,363,618 and 4,375,351 and the various references cited and discussed therein are germane to the general technology discussed herein. All the above patents have been assigned to the same assignee as the present case.

U.S. Pat. Nos. 4,650,366 and 4,386,901 disclose screeds capable of formless, self-supporting or floating operation. The latter patent discloses a triangular truss screed operated by two workmen without the use of forms. U.S. Pat. No. 4,650,366 discloses a light weight, portable vibrating screed including a central, extruded beam element.

U.S. Pat. No. 4,431,336 discloses a vibrating finishing screed for use upon plastic concrete that apparently is capable of floating. U.S. Pat. No. 2,314,985 discloses a vibratory hand screed including a central, vibrated pan for use upon plastic concrete without forms. Other prior art screeds, generally of the "form-riding" type, that are of general relevance include those screeds disclosed in U.S. Pat. Nos. 4,340,351; 4,105,355; 2,651,980; 2,542,979; 3,095,789; 2,693,136; and 4,030,873.

Stilwell, U.S. Pat. No. 4,427,358, discloses a coupling for eccentrically weighted driveshafts for vibratory screeds. This coupling employs a spring biased collar to captivate and join two semicylindrical shaft segments.

Other important considerations when planing a job include the manpower and logistics necessary to perform the required work. Concrete must often be placed and finished in relatively confined spaces. For example, the floors within a building are often placed after the majority of the structural elements are erected. Therefore, a contractor may well find it necessary to finish a floor after the erection of several disruptive structural elements. Often open areas are interrupted by structural members such as columns, beams, ductwork, or other similar protrusions. Although known screeds are generally convertible in length by breaking the screed down and removing or replacing sections, the work is tedious and expensive.

It is desirous to provide a screed that readily clears obstacles without adding or removing sections. It is further advantageous to provide a screed that can bypass columns and obstructions during finishing operations. It is desirable that the bypass readily lock in a deployed position in axial alignment with the rest of the screed and its elements (i.e., strike-off, pan float and/or bull float) when necessary. Additionally, the bypass should readily lock in a retracted, passive position.

SUMMARY OF THE INVENTION

I have provided an obstacle bypass arrangement for concrete tools that dynamically varies in length to avoid unmovable obstructions. Preferably my bypass system comprises a hinged wing section that can be dynamically linked to the extremities of the screed. The bypass wing can be locked in an actively deployed position for finishing concrete. When deployed, the bypass wing is axially aligned with the main screed body, and the wing is preferably vibrated by an electric or hydraulic vibrator. The bypass wing may be retracted to a passive position out of contact with the concrete. When retracted, the bypass wing is angularly nested to the finishing tool in an out-of-the-way orientation.

The column bypass system comprises a finishing wing, a vibration mechanism and a linkage connecting it to the main screed. The wing comprises an interconnected strike-off and bull float. A pan extending between the bull float and strike-off is employed in some screeds. Preferably a bracket on the end of the main screed pivotally mounts the bypass. Bolts and flanges pivotally join the main screed strike-off to the bypass strike-off and the main screed bull float to the bypass bull float. The wing pivots between the actively deployed and retracted passive positions. The linkage extends from the bracket to the wing and operates to lock the wing in either the deployed or retracted position.

The linkage system comprises two, rigid links that are interconnected at an intermediate pivot point. As the wing is foldably deployed, the links move into general coaxial alignment, and the linkage elongates as the links orient themselves end-to-end. At this time they pass overcenter, and gently assume a locked position. When the wing is retracted, the links pivot at the intermediate pivot point. Rotation discussed hereinafter about other pivot points rotates the intermediate pivot point upwardly. As the links move downwardly, they assume a subtractive disposition in effect shortening the linkage means. The linkage means preferably moves overcenter to yieldably lock the wing in the retracted passive position.

The preferred vibratory mechanism is an electric vibrator located on the link attached to the wing. In this location, the vibrator is nearest the screed working surfaces when the wing is deployed. It also rotates to a protected position within the bracket when the wing is fully retracted to the passive position.

Thus a primary object of the present invention is to provide a conveniently operable column bypass system for concrete finishing tools.

A particular object of the present invention is to quickly vary the length of a concrete tool such as a vibrating screed.

A related object is to obviate the need for connecting and disconnecting screed sections.

Another object is to provide a column bypass wing that will facilitate finishing plastic concrete in a single pass.

A related object is to provide a column bypass that can easily be retrofitted to conventional screeds.

Another fundamental object of the present invention is to provide a floating vibrating screed of the character described that may be used with a variety of screed lengths and configurations.

Yet another object is to provide a column bypass that may be used in finishing plastic concrete with or without forms.

Still a further object of the present invention is to provide a column bypass of the character described that provides and distributes uniform vibration.

A related object is to provide a variable length concrete finishing device ideal for use within confined areas.

A similar object is to provide a portable, floating vibrating screed of the character described that may be easily manipulated to avoid obstacles such as columns, pipes, wiring, conduits and the like which might otherwise interrupt or impede conventional screeds.

A similar basic object is to provide an easily operable vibrating screed of the character described adapted to strike-off and float-finish concrete without forms.

Still a further object is to facilitate the formless placement of slabs within existing or partially completed structures.

Another object is to provide a bypass that preserves a screed's balance and self-support when resting or moving over plastic concrete.

Still another basic object is to reduce labor costs.

BRIEF DESCRIPTION OF THE DRAWINGS

In the following drawings, which form a part of the specification and are to be construed in conjunction therewith, and in which like reference numerals have been employed throughout in the various views wherever possible.

A further object is to provide a concrete finishing device that uniformly contacts the plastic concrete surface.

Another object is to provide a device of the character described that is easily balanced and is self-supporting.

Another object is to facilitate the finishing large areas of plastic concrete with a minimum of personnel and with minimal repetition.

These and other objects and advantages of the present invention, along with features of novelty appurtenant thereto, will appear or become apparent in the course of the following descriptive sections.

DETAILED DESCRIPTION

This Continuation-in-Part application incorporates structure and teachings of its parent, Ser. No. 07/903,936, filed Jun. 26, 1992, GAU 3206, Examiner J. M. Husar, entitled "Laser Operated Automatic Grade Control System for Concrete Finishing," that is hereby incorporated by reference.

Figure 1:
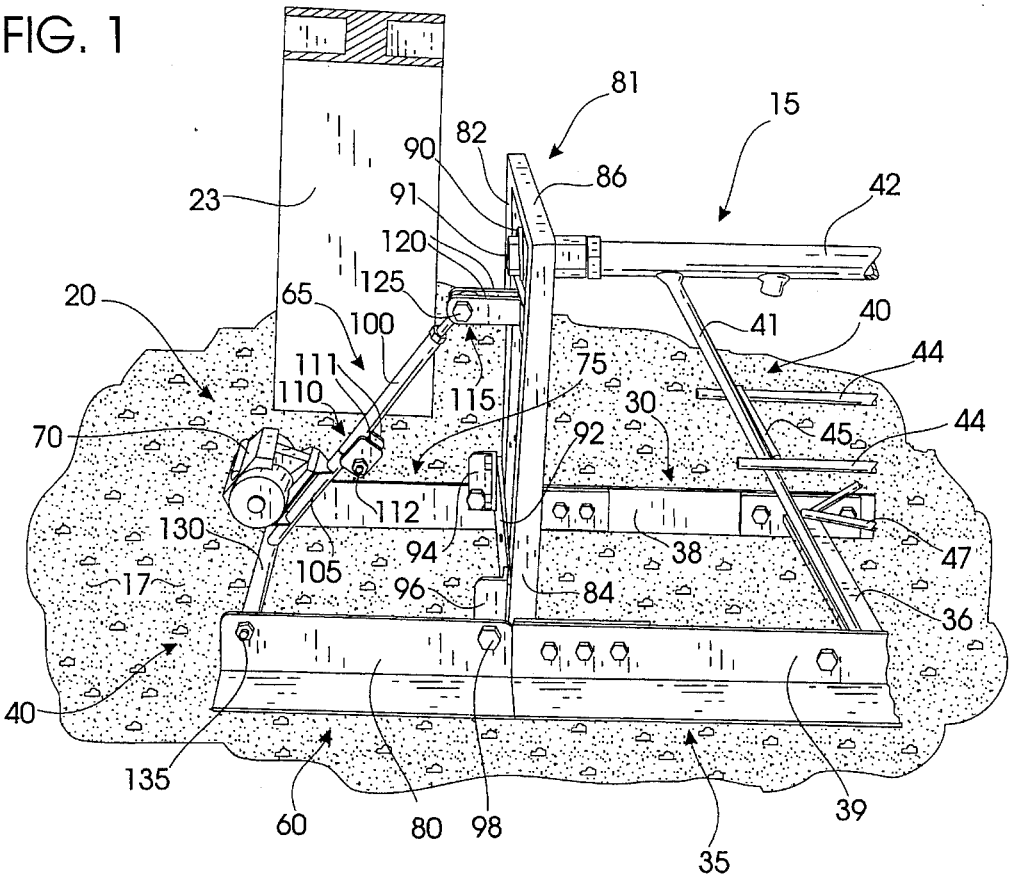
FIGS. 1–4 are fragmentary, isometric environmental views of the preferred system, sequentially illustrating wing bypass movement between the fully deployed position of FIG. 1 and the fully retracted position of FIG. 4.
Figure 4:
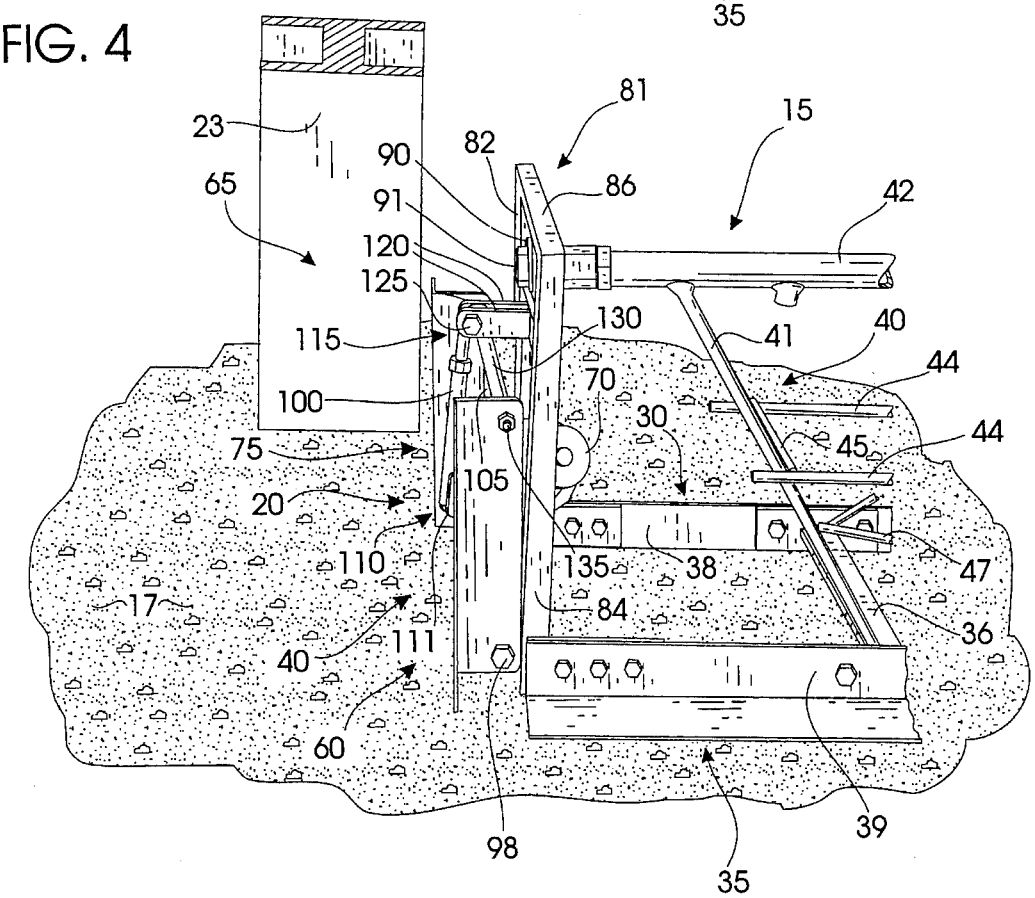
Figure 5:
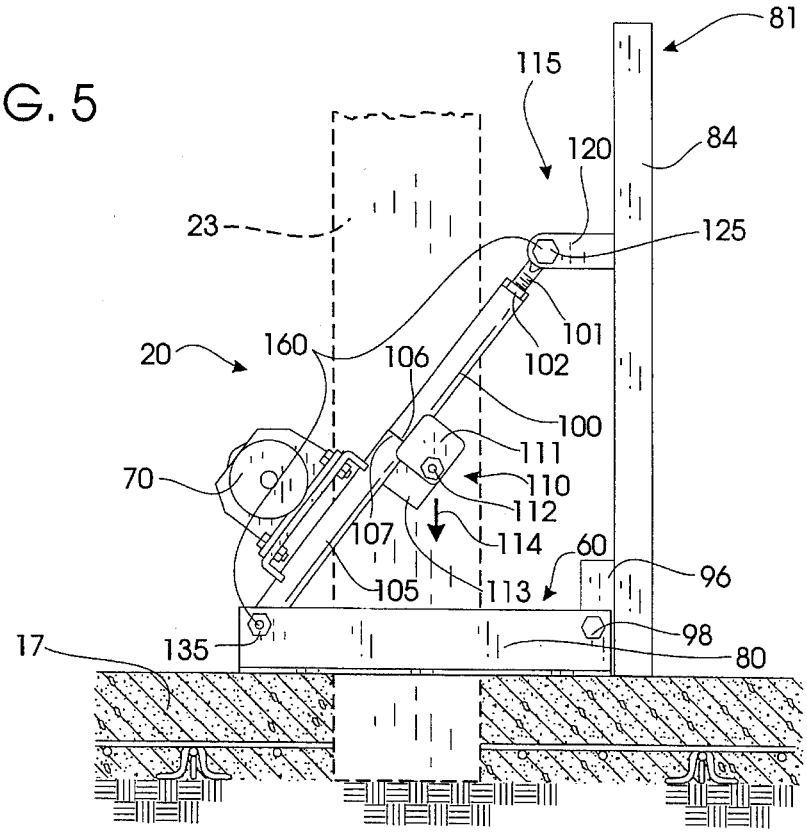
FIG. 5 is a fragmentary, elevational diagrammatic view with portions broken away or omitted for clarity, illustrating folding of the preferred linkage.

With attention now directed to the accompanying drawings, my overcenter obstacle bypass for concrete finishing is broadly designated by the reference numeral 20. It is attached to the end of an elongated concrete finishing tool such as screed 15 for finishing a slab 17 (FIG. 1). The bypass 20 releasably locks in either a deployed position (FIG. 1) of a retracted position (FIGS. 4, 5). When deployed, the bypass 20 is generally axially aligned with the body of the finishing tool 15 (FIG. 1). When the bypass 20 is retracted the length of the finishing tool shortens, so obstacles can be cleared. When retracted, the bypass wing folds into the tool 15 (FIG. 4) and is out of contact with the concrete slab 17. With the bypass 20 in a retracted position, the shortened tool 15 can clear obstacles such as columns 23 or curbs. Preferably my obstacle bypass 20 is vibrated. The bypass is preferably vibrated by a pneumatic or electric vibrator 70. The vibrator may be interconnected to vibrators disposed on the finishing tool 15 or it may be independently operated.

The illustrated concrete finishing mechanism is a screed 15 (FIG. 1), but a strike-off, a float, or other form of bladed finishing device may employ the concept. As will be recognized by those skilled in the art, such finishing mechanisms are assembled from several sections at the job site to provide the desired length. The illustrated main screed 15 is a modular unit comprising a strike-off blade 30 and companion angular portion 35 that aids in floating. Strike off 30 initially levels freshly placed concrete. The strike-off 30 is spaced apart from portion 35 by a cross piece 36 extending between flanges 38, 39 that are oriented vertically to the plane of the slab 17. Alternatively, a finishing pan may extend between the strike-off 30 and member 35. The aforementioned cross pieces 36 join the integral triangular-truss screed frame 40 and the concrete finishing elements. The screed frame 40 comprises trusses 41 angularly extending from the intersection of the cross piece 36 and the strike-off or bull float flanges 38, 39 to a frame apex pipe 42. Stringers 44 run generally parallel to the apex pipe 42 while stringer 45 is perpendicular to the apex pipe 42. Both stringers 44, 45 are secured to the trusses 41. Cross braces 47 further reinforce the area between the strike-off 30 and the bull float 35.

Figure 2:
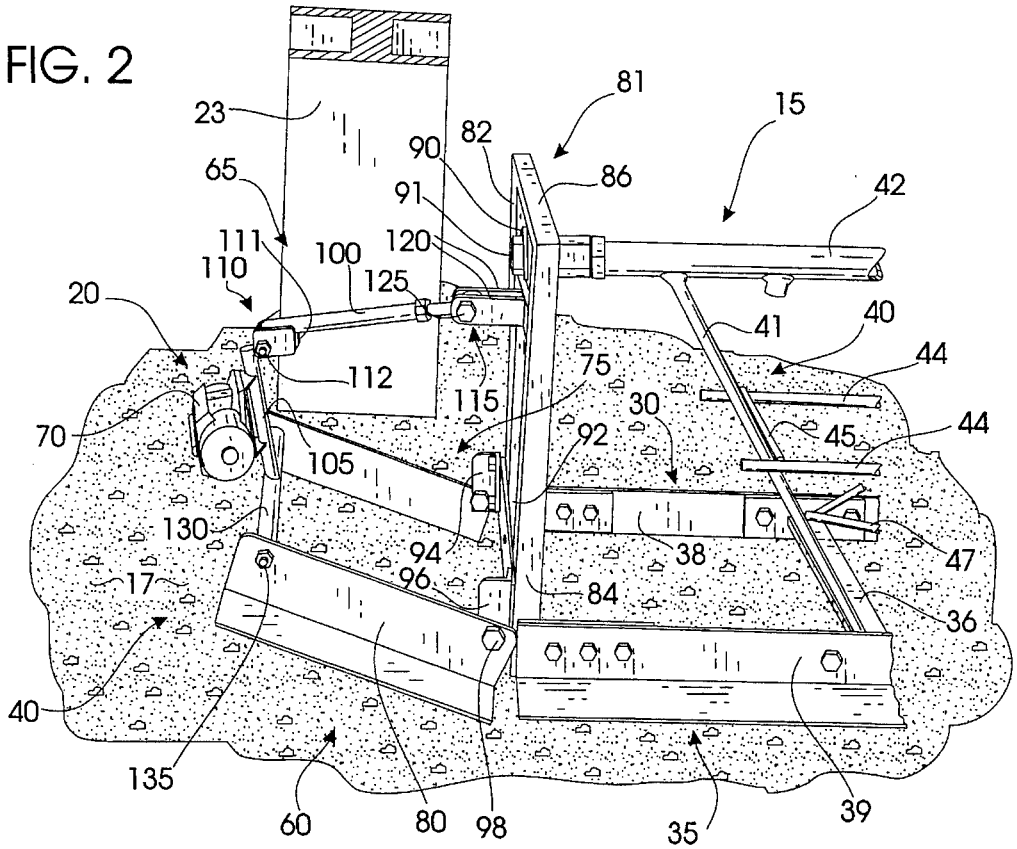

The overcenter obstacle bypass 20 comprises a finishing wing 60 controlled by a linkage system 65. Preferably a vibration mechanism 70 is mounted to the wing. The finishing wing 60 comprises a strike-off 75 and a spaced apart float 80. Alternatively, a finishing pan may extend between the bull float 80 and the strike-off 75. In the best mode of the invention, a rigid, upright terminal bracket 81 secured to the end of screed frame 40 pivotally mounts the obstacle bypass 20. The bracket 81 comprises two generally vertical uprights 82, 84 braced apart by a transverse header 86, an intermediate, parallel strut 88 (FIG. 5A), and a lower, parallel strut 92 (FIGS. 1, 2) that extends across the base of the bracket. A mounting plate 90 secured between the header 86 and the strut 88 mounts the apex tube 42 of the screed 15 with a bolt 91.

Figure 10:
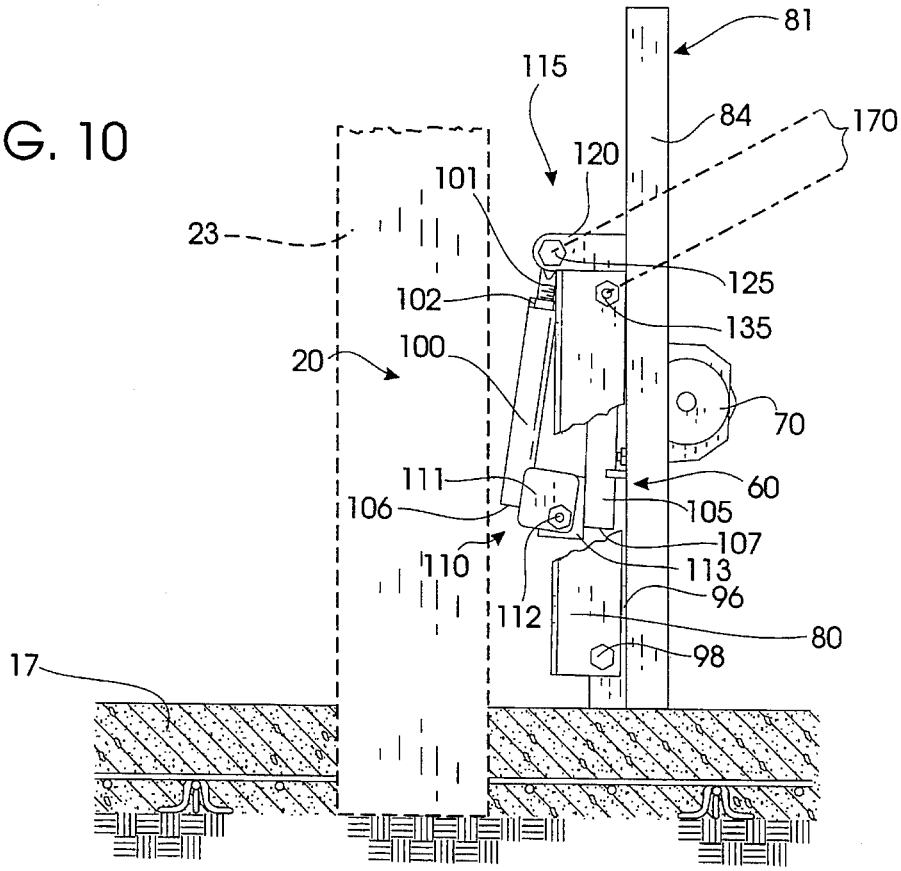

L-shaped flanges 94, 96 extend outwardly from lower strut 92 at the base of each upright 82, 84. Bolts 98 pass through an orifice defined in each of the flanges 94, 96 and a matching orifice defined in the inboard end of the wing float 80 and wing strike-off 75. The wing 60 pivots at these bolts 98 between the deployed position (FIGS. 1 and 5) and the retracted, bypass position (FIGS. 4 and 10).

Figure 5A:
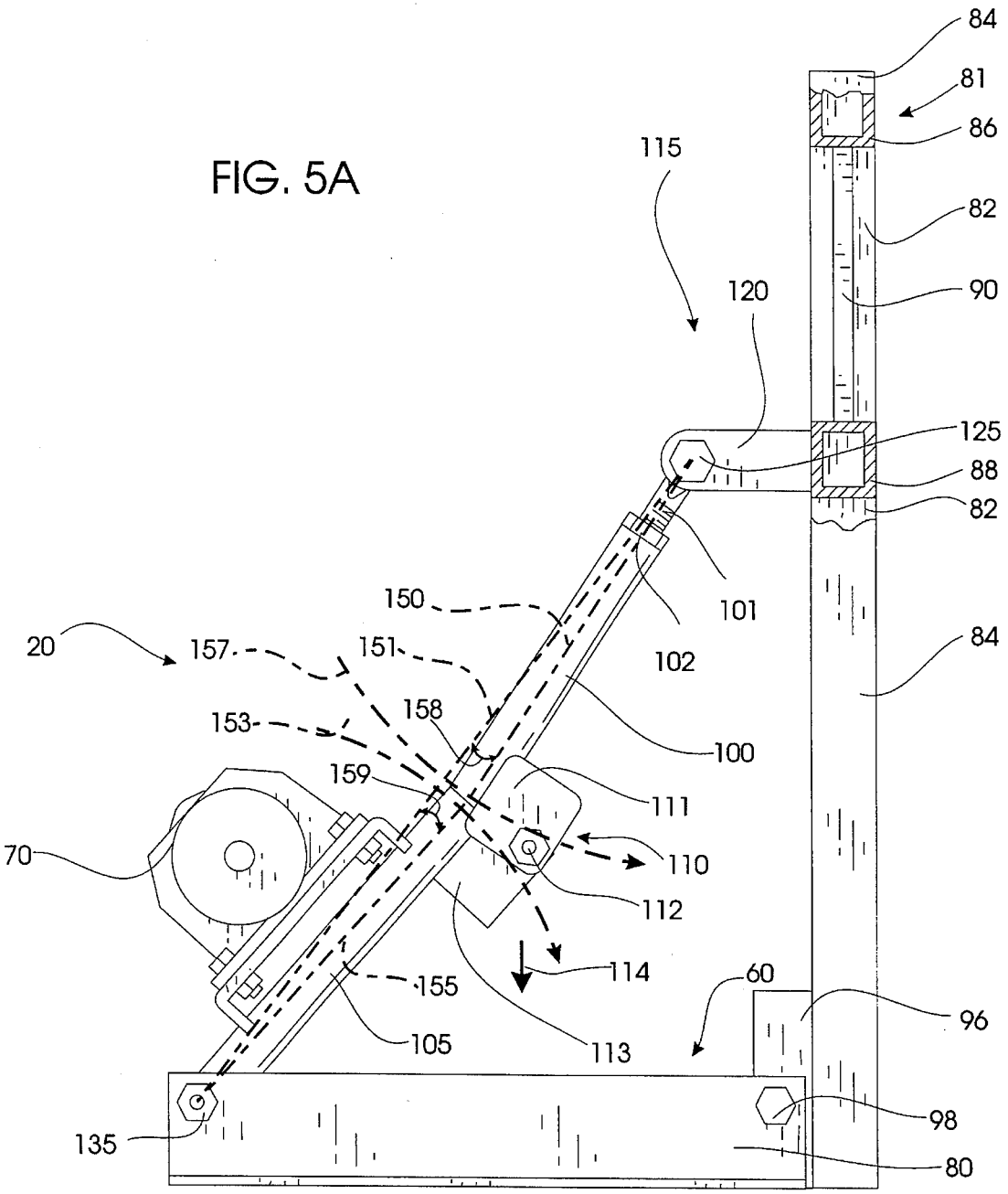
FIG. 5A is an enlarged, fragmentary diagrammatic view illustrating the overcenter action of the linkage in the deployed position, with the actual movement exaggerated for clarity; and, FIGS. 6–10 are fragmentary, elevational diagrammatic views with portions broken away or omitted for clarity, sequentially illustrating the folding operation of the preferred linkage.

The overcenter linkage system 65 dynamically extends from an outer extremity or end of the tool 15 (preferably from bracket 81) to the wing 60. It facilitates controlled movement of the wing 60 between the retracted clearance position and the active deployed position. Preferably the linkage 65 yieldably locks the wing 60 in either the fully deployed (FIG. 5A) or retracted position (FIGS. 4 and 10). Linkage system 65 comprises a bracket link 100 and a wing link 105 interconnected at an intermediate pivot point 110 (FIG. 5A). The bracket link 100 threadably receives an adjustable extension 101 (FIGS. 5A, 6) secured by jam nut 102. Extension 101 permits adjustments to length of the link and the linkage means.

The top of the linkage means is connected to the end of the screed. Preferably link 100 is pivoted to end bracket 81 (i.e., the bracket strut 88) within a shackle 115. The shackle 115 comprises a pair of generally parallel arms 120 extending outwardly from the strut 88. The arms 120 define central orifices for receiving a pivot bolt 125.

Figure 6:
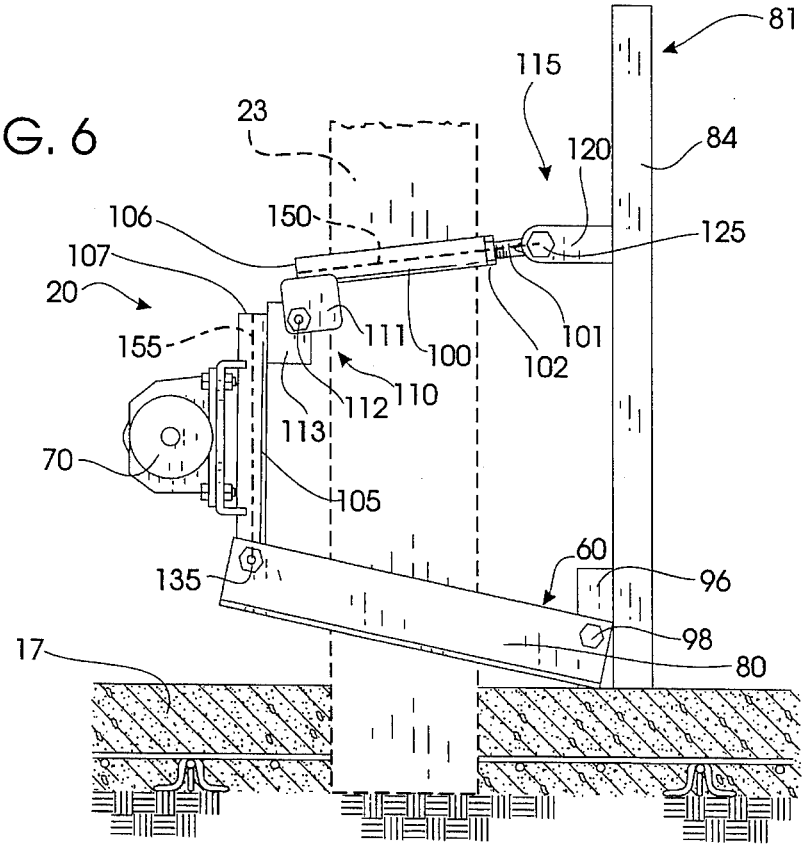

The bracket link 100 abuts the wing link 105 adjacent an axially offset, intermediate pivot 110. When the wing is deployed (FIG. 5) abutment of the ends 106, 107 (FIGS. 5, 6) of the two links 100, 105 generally coaxially aligns their longitudinal axes 150, 155 (FIG. 6). The intermediate pivot 110 is established by mutual coupling of offset tabs 111, 113 emanating from link ends 106, 107 respectively, that are pivoted together by bolt 112. The wing link 105 extends from the pivot point 110 to the wing 60. It is rigidly affixed to a crossmember 130. The crossmember 130 perpendicularly connects the strike-off 75 to the bull float 80. The crossmember 130 is mounted on an axle 135 to pivotally couple the linkage 65 to the wing 60.

When the wing is deployed, the links 100, 105 are generally coaxially aligned and abutting. Alignment of the longitudinal axes 150, 155 of the two links 100, 105 and the abutment of their ends 106, 107, together with the location of the offset intermediate pivot point 110 directly beneath that abutment results in a stable deployed position. When the links 100 and 105 are coaxially aligned as the wing deploys, and their ends 106, 107 abut, (FIG. 5, 5A) elongation of the linkage means is maximum. Because of the pivot points disclosed, ends of the links describe arcs 153 and 157 (FIG. 5A) when they move. Partially because of offset pivot 110, link axis alignment is displaced overcenter from the maximum tension position indicated by line 151 (FIG. 5A) as the wing is fully deployed and yieldably locked. As the links slip overcenter, as shown by arcs 158 and 159, the linkage "relaxes" somewhat in this slightly shortened but stable position.

Further, this overcenter deployment gravitationally resists any movement of the wing 60 because the center of mass vector 114 of the wing 60 acting on the pivot point 110 produces a force that acts downwardly to effectively lock the wing 60 in the deployed position. This force must be externally overcome by lifting before the wing 60 will move upwardly.

Figure 3:
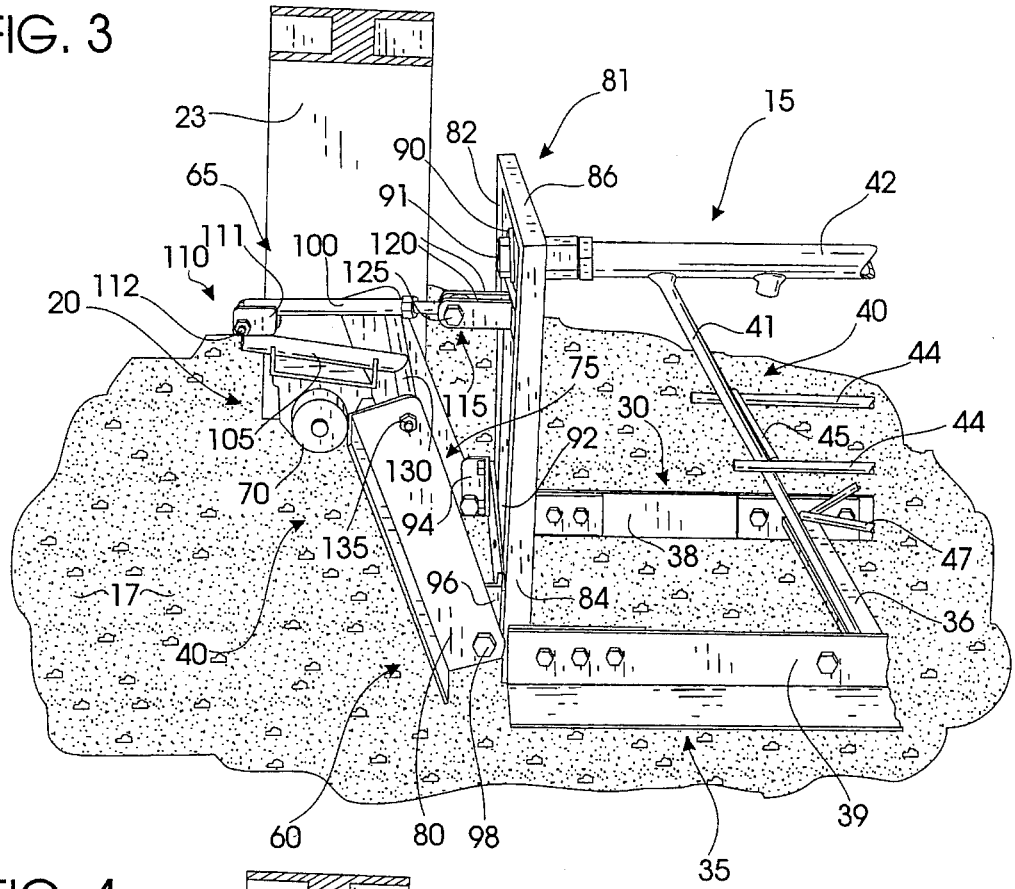
Figure 7:
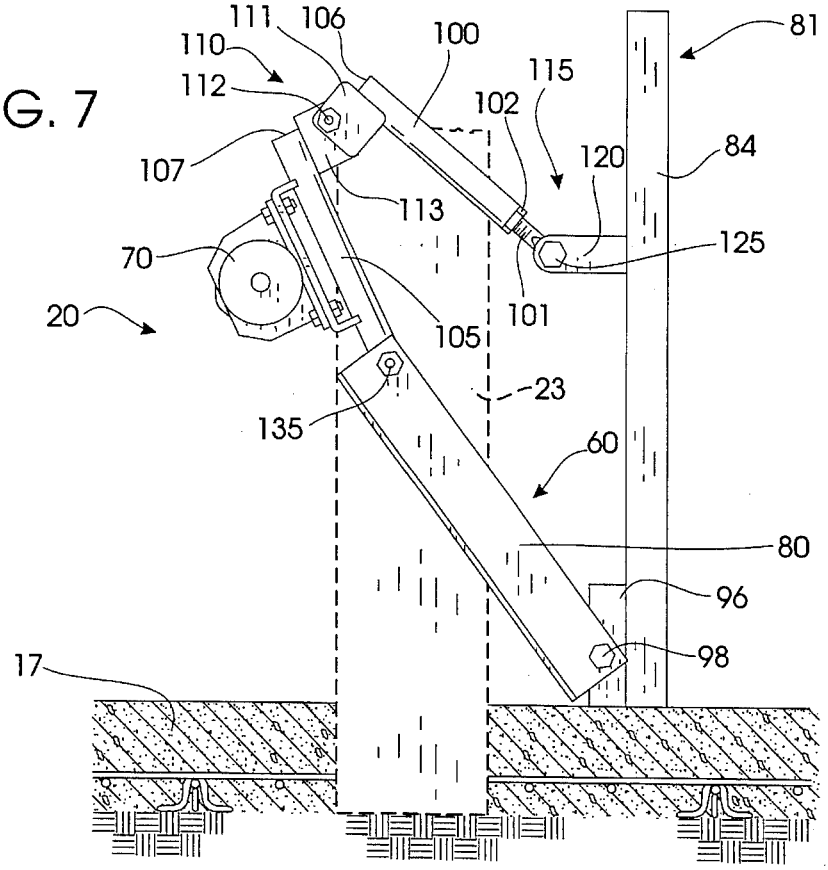
Figure 8:
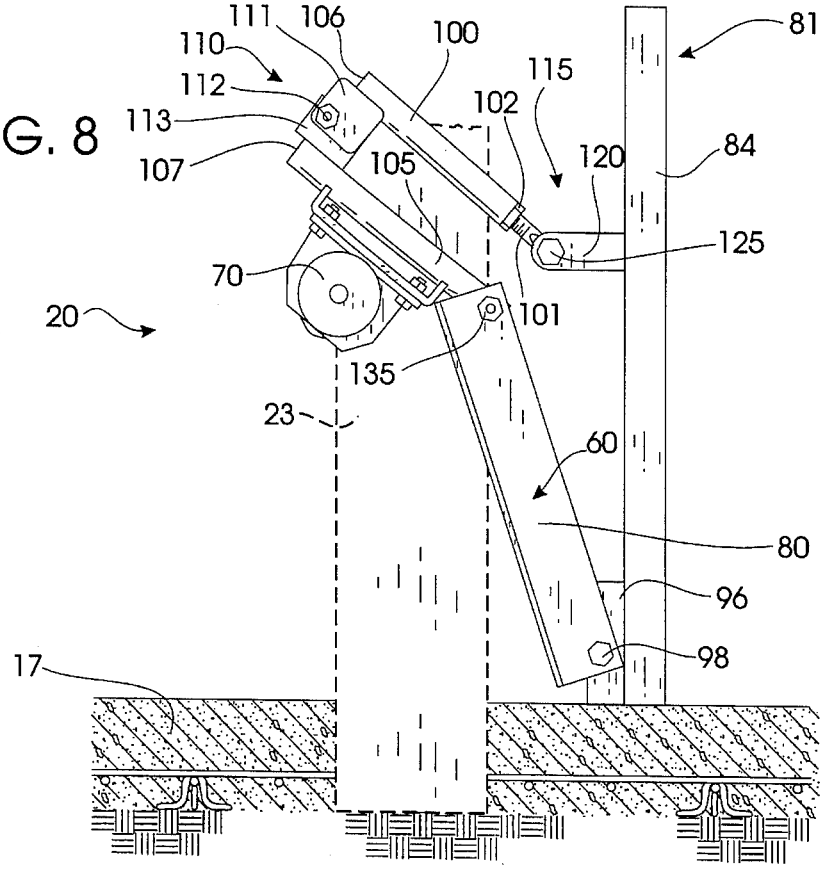
Figure 9:
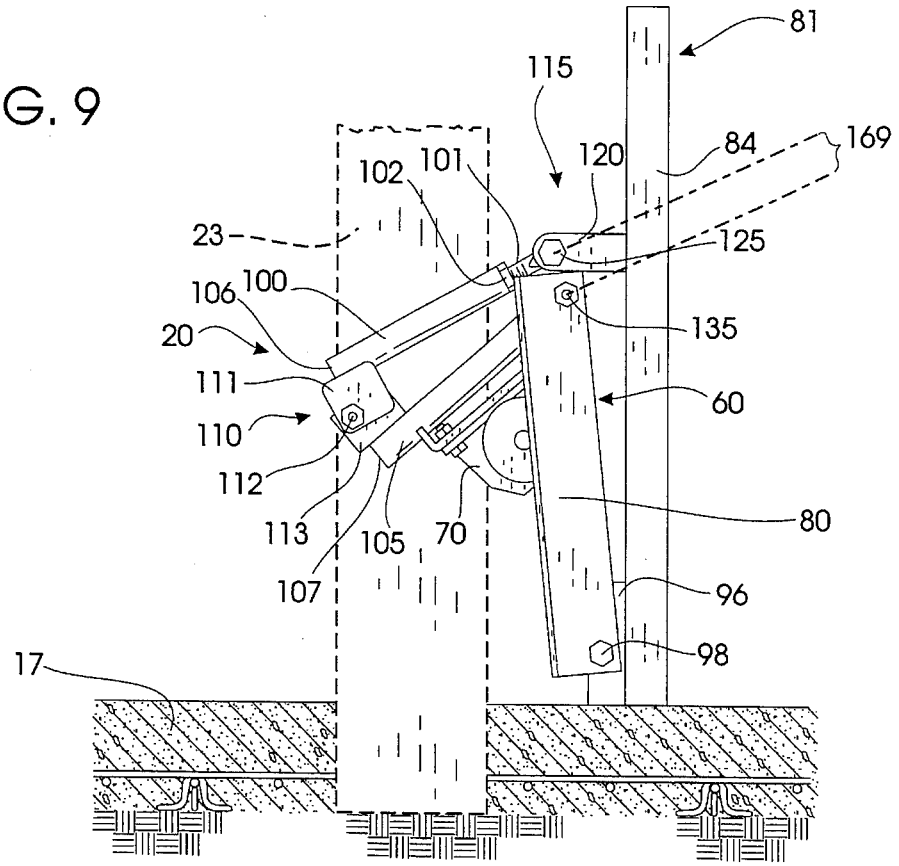

When the wing 60 is retracted, the linkage system 65 is initially displaced upwardly and outwardly at the intermediate pivot point 110, and then displaced downwardly and inwardly at the other pivot points to its fully retracted position. Force from underneath pivot 110 must be applied to "break" the extended links 100, 105, moving them out of the tensioned and elongated "length additive" position of FIGS. 1 and 5A and towards the partially folded orientation of FIG. 2. The linkage means assumes a reduced "subtractive" net length as the links 100, 105 fold together and move into a parallel orientation (FIGS. 3, 7). As wing pivot axle 135 moves toward pivot bolt 125, the reduced-length linkage system 65 can fold downwardly and inwardly toward the bracket 81 (FIGS. 8, 9). In FIG. 8 each link longitudinal axis is substantially parallel. As the wing further retracts, maximum linkage stress occurs when the pivots established at 125, 135 are closest together, as approximately illustrated in FIG. 9. This distance has been illustrated by the reference numeral 169. At this time the wing end effectively is tensioned toward arms 120. At this point the effective length of the linkage system is moving towards a minimum that is equal to the difference in the lengths of individual links 100, 105 (i.e., approximately the distance between pivots established at 125, 135). As folding continues, the vibrator 70 breaks the plane between sides 82, 84 of the bracket 81 (FIG. 10) and the wing is nested inwardly in an out-of-the-way clearance position. The links 100, 105 again move overcenter, as the distance between pivots at 125, 135 expands slightly as the links move overcenter, resulting in slightly relaxed spacing 170 (FIG. 10).

Thus the effective length of the linkage varies between a combined "additive" length 160 (FIG. 5) equal to the sum of the length of the links 100, 105 when the wing is deployed, and a subtractive length 169 equal to the difference of the length of the links 100, 105 when the wing is retracted. Preferably, the wing link 105 is shorter than the bracket link 100 to facilitate nesting of the linkage 65 and disposition of the wing 60 generally perpendicular to the tool 15.

Electric vibrator 70 vigorously vibrates the wing 60. In the preferred embodiment the secondary vibrator is mounted directly on the overcenter linkage 65. It is ideally affixed to the wing link 105. Alternatively, any conventional independent vibrator can be used.

Operation

As the screed 15 mounting my overcenter obstacle bypass 20 passes over concrete 17 to be finished, the bypass 20 may be displaced to a retracted position to allow clearance of obstacles such as columns 23, protruding wall sections or curbs. It is not necessary to halt the screed or the vibration mechanisms to retract the bypass.

With attention now directed to FIGS. 1–4 and 5–10, the folding operation required to retract the bypass is sequentially illustrated. To retract the deployed bypass, an individual begins by gripping the linkage 65 near the offset intermediate pivot point 110 and pulling it outwardly and upwardly (FIG. 6). The links 100, 105 pivot at the intermediate pivot point 110 and at shackle 115 and about axle 135 to move the intermediate pivot point 110 upwardly. This force overcomes the overcenter resting state of the bypass. The wing 60 is then lifted and retracted toward the screed bracket 81 as illustrated in FIGS. 7 and 8. The links 100, 105 pivot only at shackle 115 and about axle 135. As the crossmember 130 moves inside the pivot bolt 125 on the shackle 115, the folded linkage 65 swings downwardly (FIGS. 9 and 10) to lock the wing 60 in position. Once the bypass 20 is fully retracted, the folded linkage 65 nests within the wing 60.

To redeploy the wing 60, the reverse procedure is followed. When the wing 60 is deployed, the links 100, 105 are coaxially aligned and locked at their intermediate pivot point 110.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A concrete finishing tool that selectively bypasses obstacles during concrete finishing, said tool comprising:

elongated finishing means for contacting and finishing plastic concrete, said finishing means comprising at least one wing selectively disposed either in a deployed position for finishing concrete or in a retracted position out of contact with said concrete for clearing obstacles; and, linkage means for moving said wing between said deployed and retracted positions, said linkage means moving overcenter to yieldably lock said wing, and said linkage means comprising:

first and second rigid, elongated links that are pivoted together to establish an intermediate pivot point;

each of said first and second links having a predetermined length;

one of said links pivoted to said finishing means and the other is pivoted to said wing; and, whereby the effective length of said linkage means varies between an additive length approximately equal to the sum of the length of said first and second links when the wing is deployed and a subtractive length approximately equal to the difference in the length of said first and second links when the wing is retracted.

2. The tool as defined in claim 1 wherein when the wing is substantially retracted the effective length of said linkage means reduces to the approximate difference in said predetermined lengths of the links, and the linkage means rotates overcenter to relax tension and yieldably lock the wing in a stable retracted position.

3. The tool as defined in claim 2 further comprising vibration means mounted on said linkage means for vibrating said wing, said vibration means protectively nested within said finishing means behind said linkage means and said wing when said wing is retracted.

4. An elongated concrete finishing tool that selectively bypasses obstacles during operation, said tool comprising:

external wing means coupled to an outer end of said tool for deployment either in a deployed position in substantial alignment with said tool for contacting said concrete, or in a retracted position out of contact with said concrete for bypassing obstacles;

a linkage adapted to selectively permit said wing means to move between said deployed and said retracted position, said link comprising a bracket link and a wing link, each of said links having an outer end and an interior end, wherein said interior ends are pivoted together at an intermediate pivot point, wherein said bracket link outer end is pivoted to said finishing means and said wing link outer end is pivoted to said wing means; and, whereby the effective length of said linkage varies between an additive length approximately equal to the sum of the length of the links when the wing means is deployed and a reduced subtractive length approximately equal to the difference of the lengths of the links when the wing means is retracted.

5. The tool as defined in claim 4 further comprising vibration means mounted on said linkage for vibrating said wing means, said vibration means protectively nested within said finishing means when said wing is retracted.

6. An obstacle bypass clearance wing system for concrete finishing tools, said wing system comprising:

at least one foldable wing adapted to be disposed either in a deployed position for finishing concrete or in a retracted position out of contact with said concrete for clearing obstacles; and, linkage means for moving said wing between said deployed and retracted positions, said linkage means elongating or contracting to respectively deploy or retract said wing, wherein:

said linkage means comprises a rigid, elongated bracket link means and a rigid, elongated wing link means pivoted together at an intermediate pivot for foldably contracting or elongating to retract or deploy said wing;

said bracket link means and said wing link means each having a predetermined length;

said bracket link means is pivoted to said finishing tool and said wing link means is pivoted to said wing; and, whereby the effective length of said linkage means varies between an additive length approximately equal to the sum of the lengths of the bracket link means and the wing link means when the wing is deployed and a subtractive length approximately equal to the difference in the lengths of said bracket link means and said pivot link means when the wing is retracted; and, wherein the linkage means rotates about the pivot point established where said bracket link means is pivoted to said finishing tool into a nested position substantially behind said wing and within said finishing tool when the wing is retracted.

7. The wing system as defined in claim 6 wherein the pivot link means and the bracket link means yieldably lock overcenter when extended to deploy the wing.

8. The wing system as defined in claim 7 wherein each link means has a longitudinal axis and each last mentioned axis is substantially coaxially aligned when the wing is deployed.

9. The wing system as defined in claim 6 wherein when the wing is substantially retracted the first and second link means move overcenter to relax tension and yieldably lock the wing in a stable retracted position.

10. The wing system as defined in claim 9 further comprising vibration means mounted on said linkage means for vibrating said wing, said vibration means protectively nested within said finishing means when said wing is retracted.

11. A bypass wing system for concrete finishing tools that selectively bypasses obstacles, said wing system comprising:

at least one external wing coupled to an outer end of said tool adapted to be disposed either in a deployed position contacting said concrete, or in a folded, retracted position out of contact with said concrete for bypassing obstacles;

linkage means for deploying or retracting said wing, said linkage means comprising first and second rigid links that are pivoted together at an intermediate pivot point, wherein one of said links is pivoted to said tool and the other of said links is pivoted to said wing; and, whereby the effective length of said linkage means varies between an additive length approximately equal to the sum of the length of the links when the wing is deployed and a reduced subtractive length approximately equal to the difference of the lengths of the links when the wing is retracted.

12. The wing system as defined in claim 11 wherein the links yieldably lock overcenter when extended to deploy the wing.

13. The wing system as defined in claim 12 wherein each link has a longitudinal axis and each last mentioned axis is substantially coaxially aligned when the wing is deployed.

14. The wing system as defined in claim 11 wherein the links move overcenter to relax tension and yieldably lock the wing in a stable retracted position.

15. The wing system as defined in claim 14 further comprising vibration means mounted on said linkage means for vibrating said wing, said vibration means protectively nested within said finishing means when said wing is retracted.

* * * * *